US007380899B2

(12) United States Patent
Arakawa et al.

(10) Patent No.: US 7,380,899 B2
(45) Date of Patent: Jun. 3, 2008

(54) INKJET PRINTER

(75) Inventors: Hiroaki Arakawa, Uenohara-machi (JP); Takayuki Kato, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 277 days.

(21) Appl. No.: 11/251,656

(22) Filed: Oct. 17, 2005

(65) Prior Publication Data

US 2006/0092211 A1 May 4, 2006

(30) Foreign Application Priority Data

Oct. 22, 2004 (JP) ..... 2004-308737

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS 6,089,693 A 7/2000 Drake et al.
6,517,184 B1 * 2/2003 Bruch et al. ..... 347/23
6,847,465 B1 * 1/2005 Wetchler et al. ..... 358/1.13
2004/0223025 A1 * 11/2004 D'souza et al. ..... 347/19

FOREIGN PATENT DOCUMENTS

| | | |
|---|---|---|
| EP | 1034935 | 9/2000 |
| EP | 1308279 | 5/2003 |
| GB | 2360491 | 9/2001 |

OTHER PUBLICATIONS

Search report issued by the European Patent Office for application No./patent No. 05109660.0-2304, dated Jan. 20, 2006.*

* cited by examiner

*Primary Examiner*—Lamson Nguyen
*Assistant Examiner*—Justin Seo
(74) *Attorney, Agent, or Firm*—Lucas & Mercanti, LLP

(57) ABSTRACT

An inkjet printer having: recording head 1 including a plurality of nozzles; defective nozzle detection means 8 for detecting a defective nozzle from which ink droplets are not ejected for each of the of aforesaid recording head 1; a determination means for determining a level of a defective nozzle occurrence situation that is detected by aforesaid defective nozzle detection means 8; and an operation control means for controlling the execution of operations of a printer based on the determination result in aforesaid determination means.

7 Claims, 5 Drawing Sheets

| COLOR | k |
|---|---|
| DARK BLACK | 3 |
| DARK MAGENTA | 2 |
| DARK MAGENTA | 3 |
| DARK CYAN | 3 |
| LIGHT BLACK | 2 |
| LIGHT YELLOW | 1 |
| LIGHT MAGENTA | 2 |
| LIGHT CYAN | 2 |

| NUMBER OF CONSECUTIVE NOZZLES | k |
|---|---|
| 1 | 1 |
| 2 | 2 |
| 3 | 3 |
| 4 | 4 |
| 5 | 5 |
| 6 | 6 |
| 7 | 7 |
| n | n |

| AMOUNT OF INK DROPLET | k |
|---|---|
| LARGE | 2 |
| SMALL | 1 |

FIG. 9

| LEVEL | VISIBILITY CORRECTION VALUE Sn | VISIBILITY CORRECTION VALUE St | |
|---|---|---|---|
| 1 | 1 | 1 | TO BE CLEANED IF ANY ONE RECORDING HEAD HAS AT LEAST ONE DEFECTIVE NOZZLE |
| 2 | 5 | 20 | WHEN IMAGE QUALITY IS IMPORTANT |
| 3 | 10 | 40 | ORDINARY SETTING |
| 4 | 30 | 150 | TEXTILE EASILY SPREADS INK |
| 5 | 50 | 400 | WHEN IMAGE QUALITY IS NOT IMPORTANT FOR SUCH TEXTILE AS TOWEL |

INKJET PRINTER

This application claims priority from Japanese Patent Application No. 2004-308737 filed on Oct. 22, 2004, which is incorporated hereinto by reference.

BACKGROUND OF THE INVENTION

The present invention relates to an inkjet printer, and more particularly, relates to an inkjet printer capable of adequately controlling operations of a printer depending on a defective nozzle occurrence situation in which ink droplets are not ejected from a nozzle of a recording head.

The inject printer carries out printing by ejecting fine ink droplets from many nozzles formed in a recording head towards a recording medium to land the ink droplets on the recording medium. In such an inkjet printer, when clogging occurs in a nozzle with dried ink, dust or other substances, the nozzle becomes a defective nozzle from which the ink droplets are not ejected, causing the generation of turbulence in the image.

Thus, proposed in Patent Document 1 is a technology that provides detection means for detecting an ejection state of ink droplets from each of the nozzles of a recording head and cleaning means for cleaning the recording head, detecting a defective nozzle from which the ink droplets are not ejected by the detection means, and when the defective nozzle is detected, cleaning the recording head by the cleaning means to recover the state of the recording head.

Further, proposed in Patent Document 2 is a technology that distributes image data so that a plurality of full-line type of recording heads complement each other to record the image data, and when a defective nozzle is present, overlapping the image data of the defective nozzle onto image data of a corresponding nozzle of another recording head to cause the other nozzle to substitute the defective nozzle.

[Patent Document 1] Japanese Patent Publication Laid-Open No. HEI 8-118679

[Patent Document 2] Japanese Patent Publication Laid-Open No. HEI 10-6488

In the case where an ink to be used is a light-colored yellow ink, defective nozzles which occur in several nozzles of many nozzles in the recording head are less visible, so that a user may continue printing without minding it. On the other hand, in the case of dark-colored black ink, magenta ink, and cyan ink, the presence of only one defective nozzle can be visible in the image and thereby the user may mind it.

Further, when a plurality of defective nozzles occur in the recording head(s), the case in which they are sporadically present in many nozzles of one recording head or sporadically present in a plurality of recording heads is less visually apparent as compared to the case in which the defective nozzles concentrate at adjacent nozzles of one recording head or concentrate at one recording head of the plurality of recording heads even if the number of defective nozzles is the same in both cases.

In addition, such a visual problem of defective nozzles differs depending on the type of recording medium. For example, when a defective nozzle occurs in an inkjet textile printing apparatus, the case of printing on a towel is less apparent as compared to the case of printing on a cloth having relatively smooth surface.

However, with the technology as described in Patent Document 1 that carries out the cleaning operation when a defective nozzle is detected, printing is interrupted every time when a defective nozzle is detected even if the occurrence of the defective nozzle is minor and less apparent in the image, so that there are problems of the time loss during the printing interruption, the consumption of ink associated with the cleaning operation and other disadvantages.

Further, a technology that when defective nozzles are detected, causes information such as the number of the defective nozzles to be displayed for every recording head and makes a user confirm the display to commit determination of whether to carry out the cleaning operation to the user is thought, however, the user always needs to stand by so as to confirm the display, and in this case also, printing is interrupted every time when a defective nozzle is detected, so that the problem of occurring the time loss is not solved at all.

Meanwhile, in the case of the technology described in Patent Document 2, printing is not immediately interrupted when a defective nozzle occurs, but the presence of other nozzle capable of complementing the defective nozzle when occurring is indispensable, so that the technology cannot be applied to all of the recording heads or all of the inkjet printers.

SUMMARY OF THE INVENTION

Thus the present invention addresses a problem that provides an inkjet printer capable of increasing productivity with no occurrence of the time loss by making it possible to adequately control operations of a printer depending on the defective nozzle occurrence situation.

Another problem of the present invention will be apparent from the following description.

The above problem will be solved by each of the structures below.

The structure according to Item 1 is an inkjet printer having: a recording head including a plurality of nozzles; defective nozzle detection means for detecting a defective nozzle from which ink droplets are not ejected for each of the nozzles of the recording head; determination means for determining a level of a defective nozzle occurrence situation that is detected by the defective nozzle detection means; and operation control means for controlling the execution of operations of a printer based on the determination result in the determination means.

The structure according to Item 2 is an inkjet printer having: a recording head including a plurality of nozzles; defective nozzle detection means for detecting-a defective nozzle from which ink droplets are not ejected for each of the nozzles of the recording head; determination means for determining a level of a defective nozzle occurrence situation based on the detection result of the defective nozzle detection means; reception means for receiving an input of a level of the defective nozzle occurrence situation that allows or disallows the continuation of a printer operation; and operation control means for controlling the execution of operations of the printer based on the level of the defective nozzle occurrence situation that is determined by the determination means and on the level of the defective nozzle occurrence situation that is received by the reception means.

The structure according to Item 3 is an inkjet printer having: a recording head including a plurality of nozzles; defective nozzle detection means for detecting a defective nozzle from which ink droplets are not ejected for each of the nozzles of the recording head; determination means for determining a level of a defective nozzle occurrence situation based on the detection result of the defective nozzle detection means; display means for displaying the level of the defective nozzle occurrence situation that is determined by the determination means; reception means for receiving an input from a user that allows or disallows the continuation of a printer operation based on the display result by the display means; and operation control means for controlling the execution of operations of the printer based on the input received by the reception means, wherein when an input that allows the continuation of the printer operation by the reception means is received based on the display result by the display means, the operation control means subsequently provides control so that the printer operation is continued regardless of the reception means when the determination result by the determination means is the same as the level of the defective nozzle occurrence situation at which the continuation of the printer operation is allowed by the reception means.

The structure according to Item 4 is the inkjet printer according to Item 1 or Item 2, wherein the operation control means controls whether to continue the printing operation of the printer or whether to execute the cleaning operation to recover a defective nozzle of the recording head as the printer operation.

The structure according to Item 5 is the inkjet printer according to any of Items 1 to 4, wherein the level of the defective nozzle occurrence situation is the level that is converted into numerical values indicating whether the defective nozzle is likely or unlikely to be visually apparent in an image based on the detection result of the defective nozzle detection means.

The structure according to Item 6 is the inkjet printer according to any of Items 1 to 5, wherein the defective nozzle occurrence situation includes information about a consecutive nozzle number of adjacent defective nozzles.

The structure according to Item 7 is the inkjet printer according to any of Items 1 to 6, wherein the defective nozzle occurrence situation includes information about the colors of ink droplets ejected from the nozzles of the recording head.

The structure according to Item 8 is the inkjet printer according to any of Items 1 to 7, wherein the recording head is a plurality of recording heads, and the level of the defective nozzle occurrence situation is the level for each of the recording heads.

The structure according to Item 9 is the inkjet printer according to any of Items 1 to 7, wherein the recording head is a plurality of recording heads, and the level of the defective nozzle occurrence situation is the level for all of the recording heads together.

EFFECTS OF THE INVENTION

With the structure according to Item 1, since the operations of the printer can be adequately controlled depending on the defective nozzle occurrence situation, the time loss due to executing unnecessary cleaning operation does not occur and thereby the productivity can be improved.

With the structure according to Item 2, the cleaning level can be arbitrarily set by different user depending on the circumstances and the operations of the printer can be controlled based on the cleaning level, so that a highly versatile printer can be realized.

With the structure according to Item 3, even if a defective nozzle occurs when the user confirms the image at this point and determines that the situation is within the level of no problem, subsequently it is possible to continue printing automatically without holding up the printer operation each time as long as the defective nozzle occurrence is the same level, so that printing will not be frequently interrupted each time a defective nozzle is detected, and thereby the problem of the occurrence of time loss will be eliminated.

With the structure according to Item 4, it is possible to control whether to continue the printing operation of the printer or whether to execute the cleaning operation of the printer, so that the time loss due to the execution of unnecessary cleaning operation does not occur, thereby the productivity can be improved.

With the structure according to Item 5, the degree of visibility of the defective nozzle in the image can be objectively evaluated.

With the structure according to Item 6, the information about the consecutive nozzle number of adjacent defective nozzles is a factor that is likely to be visually apparent in the image, so that the operations of the printer can be adequately controlled by being based on this information.

With the structure according to Item 7, the information about the colors of ink droplets ejected from the nozzles of the recording head is also a factor that is likely to be visually apparent in the image, so that the operations of the printer can be adequately controlled by being based on this information.

With the structure according to Item 8, the necessity of the cleaning operation or other related operations for each of the plurality of recording heads can be determined, so that unnecessary operation will not be executed relative to a defective nozzle in a recording head of a color that is unlikely to be visually apparent and the like.

With the structure according to Item 9, the defective nozzle occurrence situation in the plurality of recording heads can be determined as a whole, so that it is possible to precisely determine whether the defective nozzle is likely or unlikely to be visually apparent in the image that is printed by the plurality of recording heads.

BRIEF DESCRIPTION OF DRAWINGS

FIG. 4*a* through 4*c* are Examples of visibility coefficient tables;

FIG. 9 is a view illustrating a cleaning level.

DETAILED DESCRIPTION OF THE PREFERRED EMBODIMENT

The embodiment of the present invention will be described below.

Figure 1:
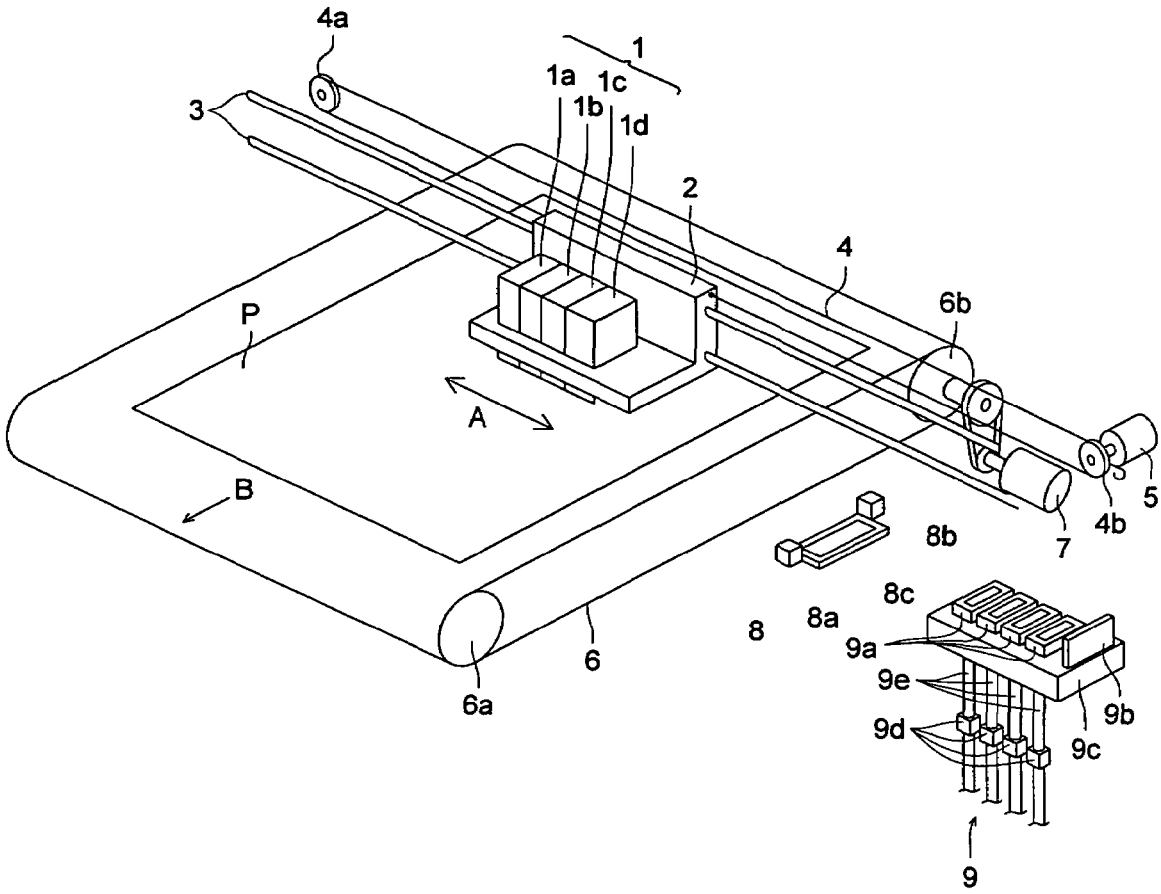
FIG. 1 is an essential part perspective view showing an inkjet printer.
Figure 2:
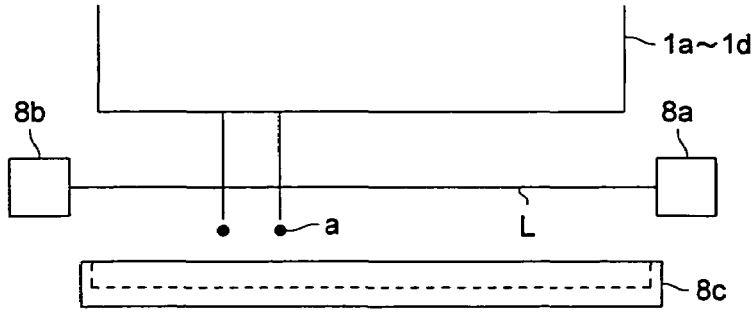
FIG. 2 is a view illustrating the detection operation of ink droplets by a defective nozzle detector.
Figures 3, 4:
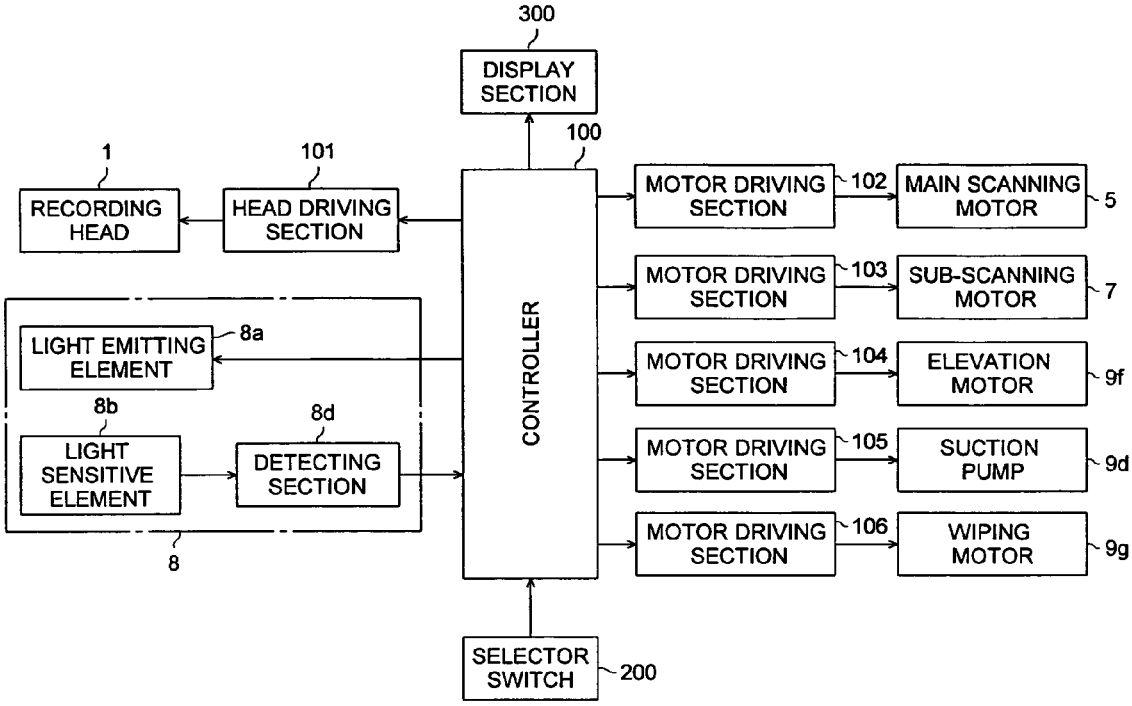
FIG. 3 is a block diagram showing the inside configuration of the key parts of the inkjet printer.

FIG. 1 is an essential part perspective view showing an inkjet printer, FIG. 2 is a view illustrating the detection operation of ink droplets by a defective nozzle detector, and FIG. 3 is a block diagram showing the inside configuration of the inkjet printer.

In FIG. 1, reference numeral 1 denotes a recording head which is herein illustrated having four recording heads 1*a* through 1*d* that eject different inks of four dark colors of yellow, magenta, cyan and black, but the number of recording heads and the colors are not specifically limited. All of the recording heads 1*a* through 1*d* are mounted in a common carriage 2. The carriage 2, in which both end portions of a wire 4 strung between two pulleys 4*a*, 4*b* are attached, is slidably provided along two guide rails 3 that extend along the main scanning direction indicated by A in the figure and are parallel to each other. Connected to one pulley 4*b* is a main scanning motor 5, and when the main scanning motor 5 is rotated and driven, the carriage 2 is pulled by the wire 4 to slide on the guide rails 3, moving forward and backward along the main scanning direction A.

Under the carriage 2, a conveyance belt 6 is provided. The conveyance belt 6 is endlessly strung between two conveyance rollers 6*a*, 6*b* that are provided in a predetermined interval in the sub-scanning direction indicated by B in the figure. Connected to one conveyance roller 6*b* is a sub-scanning motor 7 so as to be able to transmit a driving force, and when the sub-scanning motor 7 is rotated and driven, the conveyance belt 6 rotates and conveys a recording medium P such as a paper, a plastic film, or a cloth placed on the conveyance belt 6 along the sub-scanning direction B.

Reference numeral 8 denotes a defective nozzle detector for detecting a defective nozzle, which is provided so as to be opposed to under the carriage 2 when moving to a non-printing position out of the conveyance belt 6. The defective nozzle detector 8 is composed of a light emitting element 8*a* made of an LED, a laser and the like, a light sensitive element 8*b* made of a photo diode and the like, an ink tray 8*c* for receiving ink droplets ejected in the detection, and a detection section 8*d* (see FIG. 3) for carrying out the detection operation of received light signals.

In the defective nozzle detector 8, the light emitting element 8*a* projects a detection light L for detecting the passage of ink droplets a ejected from each of the nozzles of the recording heads 1*a* through 1*d* as shown in FIG. 2. The light sensitive element 8*b* receives the detection light L projected from the light emitting element 8*a*. The detection light L is projected so as to be perpendicular to the main scanning direction A of the recording heads 1*a* through 1*d* and parallel to the alignment direction of the nozzles of the recording heads 1*a* through 1*d* with the height position along the ejection direction of the ink droplets a being lower than the position of the nozzle surfaces of the recording heads 1*a* through 1*d*. With this feature, when a nozzle alignment of either of the recording heads 1*a* through 1*d* is positioned on the detection light L, the movement path of the ink droplets a ejected from the nozzle crosses with the detection light L. Thus, when the ink droplets "a" are ejected towards the detection light L by outputting drive signals relative to each of the nozzles, the ejected ink droplets a pass through the detection light L and the shadows thereof are captured by the light sensitive element 8*b* and detected by the detection section 8*d*. However, in the case where the shadows are not captured by the light sensitive element 8*b* when a predetermined period of time has passed after the drive signals were output, the ink droplets "a" are not detected by the detection section 8*d* and thereby the occurrence of defective nozzles is detected.

Incidentally, herein, the defective nozzle detector 8 has a pair of the light emitting element 8*a* and light sensitive element 8*b* for the four recording heads 1*a* through 1*d* to carry out the detection operation in each of the recording heads 1*a* through 1*d*, however, it may be also possible that the same number of pairs of the light emitting element 8*a* and light sensitive element 8*b* as the number of recording heads provided therein are provided to simultaneously carry out the detection operation for a plurality of recording heads.

Reference numeral 9 denotes a cleaning device for cleaning the recording heads 1*a* through 1*d* and is provided so as to be opposed to under the carriage 2 which further moves from the defective nozzle detector 8. In the cleaning device 9, the same number of suction caps 9*a* as the recording heads 1*a* through 1*d* for recovering the recording heads from clogging and the like by forcibly sucking ink from the nozzles when closely contacting the nozzle surfaces of the recording heads 1*a* through 1*d* and a wiping member 9*b* made of an elastic member such as a plate-like rubber for wiping a nozzle surface to wipe out the ink adhering on the nozzle surface are provided on a common base 9*c*.

The suction caps 9*a* are connected to suction pumps 9*d* via suction hoses 9*e* respectively, and when the suction pumps 9*d* are driven, the insides of the suction caps 9*a* that closely contact the nozzle surfaces of the recording heads 1*a* through 1*d* are in a state of negative pressure, so that the ink is forcibly sucked from the nozzles. The sucked disposal ink is discharged to a disposal ink tank not shown through the suction hoses 9*e*.

Further the base 9*c* is designed to be able to move up and down by an elevation motor 9*f* (see FIG. 3) and by driving the elevation motor, the contact and removal operations of the suction caps 9*a* towards the nozzle surfaces are carried out. The base 9*c* is also designed to be able to move forward and backward along the main scanning direction A by a wiping motor 9*g* (see FIG. 3) and by driving the wiping motor 9*g*, the wiping member 9*b* is slid on the nozzle surfaces of the recording heads 1*a* through 1*d* and thereby stain and ink adhering on the nozzle surfaces are wiped out. Incidentally, the cleaning device 9 may have only one function of either the suction caps 9*a* or the wiping member 9*b*.

In this inkjet printer, a controller 100 shown in FIG. 3 controls a motor driving section 102 and drives a main scanning motor 5 to move the carriage 2 along the main scanning direction A, and in the process of the movement, the controller 100 controls a head driving sections 101 provided in each of the recording heads 1*a* through 1*d* to eject ink droplets towards the recording medium P suspended on the conveyance belt 6 from the recording heads 1*a* through 1*d*. When one main scanning of the carriage 2 is completed, the controller 100 controls a motor driving section 103 to drive a sub-scanning motor 7, rotating the conveyance roller 6*b* and intermittently rotating the conveyance belt 6 to convey a predetermined amount of the recording medium P, and similar to the above description, the controller 100 repeats the next main scanning and the operation of ejecting ink droplets to record an image corresponding to image data on the recording medium P.

Incidentally, in FIG. 3, reference numeral 104 denotes a motor deriving section for controlling the drive of the elevation motor 9*f*, reference numeral 105 denotes a motor driving section for controlling the drive of the suction pumps 9*d*, and reference numeral 106 denotes a motor driving section for controlling the drive of the wiping motor 9*g*.

The controller 100, when detecting a defective nozzle by the defective nozzle detector 8, determines the level of the defective nozzle occurrence situation based on the detection result of the defective nozzle.

The defective nozzle occurrence situation may include a consecutive nozzle number of adjacent defective nozzles, the ink color of the defective nozzle, and the large or small ink droplet amount of the defective nozzle.

The consecutive nozzle number of adjacent defective nozzles is included in the defective nozzle occurrence situation, because the case where many defective nozzles occur adjacently is more likely to be visually apparent in the image than the case where a single defective nozzle occurs. The defective nozzle ink color is included in the defective nozzle occurrence situation because the dark colored black ink, magenta ink and cyan ink are more likely to be visually apparent in the image than the light colored yellow ink. Further, the large or small ink droplet amount of the defective nozzle is included in the defective nozzle occurrence situation, because the large ink droplet is more likely to be visually apparent in the image than the small ink droplet.

The level of the defective occurrence situation is the level that is converted into numerical values indicating whether the defective nozzle is likely or unlikely to be visually apparent in the image, which will be hereinafter referred to as "visibility evaluation value" in the present specification. In the controller 100, this level of the defective nozzle occurrence situation is calculated based on the detection result of the defective nozzle detector 8 and determined from the calculation result.

In order to calculate the level of the defective nozzle occurrence situation, the controller is provided with visibility coefficient tables in which the pieces of information on the defective nozzle ink color, defective nozzle consecutive nozzle number, and the large and small ink droplet amounts are weighted depending on the visibilities (the degrees of visibility in the image) respectively, wherein the visibility coefficient tables are previously set within the non-volatile memory not shown, and the controller 100 calculates the visibility evaluation value in accordance with a predetermined arithmetic equation based on the detection result by the defective nozzle detector 8 and on these visibility coefficient tables. In particular, since the defective nozzle consecutive nozzle number and the defective nozzle color are the factors that are likely to be visually apparent in the image, it is preferable to detect at least either of the consecutive nozzles number of defective nozzles or the defective nozzle color as the defective nozzle occurrence situation and thereby to set a visibility coefficient table beforehand.

An example of the visibility coefficient tables set in the controller 100 is shown in FIG. 4. This shows the case in which the controller 100 has three tables: a) the visibility coefficient table of the defective nozzle ink color; b) the visibility coefficient table of the consecutive nozzle number of defective nozzles; and c) the visibility coefficient table of the ink droplet amount.

As for the visibility coefficient table of the ink color in FIG. 4*a*, since the light colored inks are less visible than the dark colored inks, the visibility coefficients "k" are lower in the light colored inks, and of which the yellow ink is the least visible, so that the visibility coefficient "k" is set to the lowest value.

As for the visibility coefficient table of the consecutive nozzle number in FIG. 5*b*, the defective nozzles which are consecutive in the nozzle alignment are more visible than the defective nozzles which are sporadically present in the nozzle alignment, so that the visibility coefficients "k" are set to lager values as the consecutive nozzle number increases.

Further, as for the visibility coefficient table of the ink droplet amount in FIG. 4*c*, the smaller ink droplet amount is less visible, so that the visibility coefficient "k" is set to a smaller value.

The visibility evaluation value can be calculated for each recording head. A calculation example of the visibility evaluation value Sn for each recording head is shown below. For example, as shown in the following mathematical equation, the visibility evaluation value Sn can be calculated as the value that is obtained by multiplying the visibility coefficients of different visibility coefficient tables.

$$Sn = [\text{the visibility coefficient of the ink color}] \times \Sigma\{[\text{the consecutive nozzle number of the defective nozzles}] \times [\text{the visibility coefficient of the consecutive nozzle number}]\} \times [\text{the visibility coefficient of the ink droplet amount}] \quad \text{[Mathematical equation 1]}$$

Further, the visibility evaluation value can be calculated as the value for the whole recording heads all together. The visibility evaluation value St of the whole recording heads can be calculated as the value that is obtained by adding the visibility evaluation values Sn for each of the recording heads as shown in the following mathematical equation in relation to the whole recording heads.

$$St = \sum_n Sn \quad \text{[Mathematical equation 2]}$$

The controller 100 carries out the defective nozzle detection operation by the defective nozzle detector 8 at an adequate timing, for example, immediately after the power-on, immediately before the print start, after ink replacement, after recording head replacement, after recording medium replacement, or after a predetermined number of scans of the carriage 2, and then the controller 100 determines the level of the defective nozzle occurrence situation by calculating the visibility evaluation value based on the detection result to cause the display section 300 described below to display the determination result.

In FIG. 3, reference numeral 200 denotes a selection switch for receiving a selective input that allows or disallows the continuation of the printing operation from the user, reference numeral 300 denotes a display section composed of a monitor screen such as a liquid crystal panel that displays, based on the detection result of the defective nozzle detector 8, the level of the defective nozzle occurrence situation as well as various detailed information such as the detective nozzle number, color, consecutive number, and ink droplet amount.

The selection switch 200 receives an input to select whether to stop or continue the printing operation as it is, due to the determination of the user based on the information of the level of the defective nozzle occurrence situation displayed in the display section 300, and the selection switch 200 inputs the selection result in the controller 100. The controller 100 determines the level of the defective nozzle occurrence situation, and then controls the execution of the next printer operation depending on the input result of the selection switch 200.

This printer operation is the print-continue operation when the printing continuation allowance is selected by the selection switch 200, and when the printing continuation disallowance is selected, the printer operation may include the cleaning operation of the recording heads 1*a* through 1*d* by the cleaning device 9 and other operations.

When the printing continuation allowance is selected from the user by the selection switch 200, the controller 100 memorizes the level of the defective nozzle occurrence situation displayed in the display section 300 in the memory section not shown.

Figure 5:
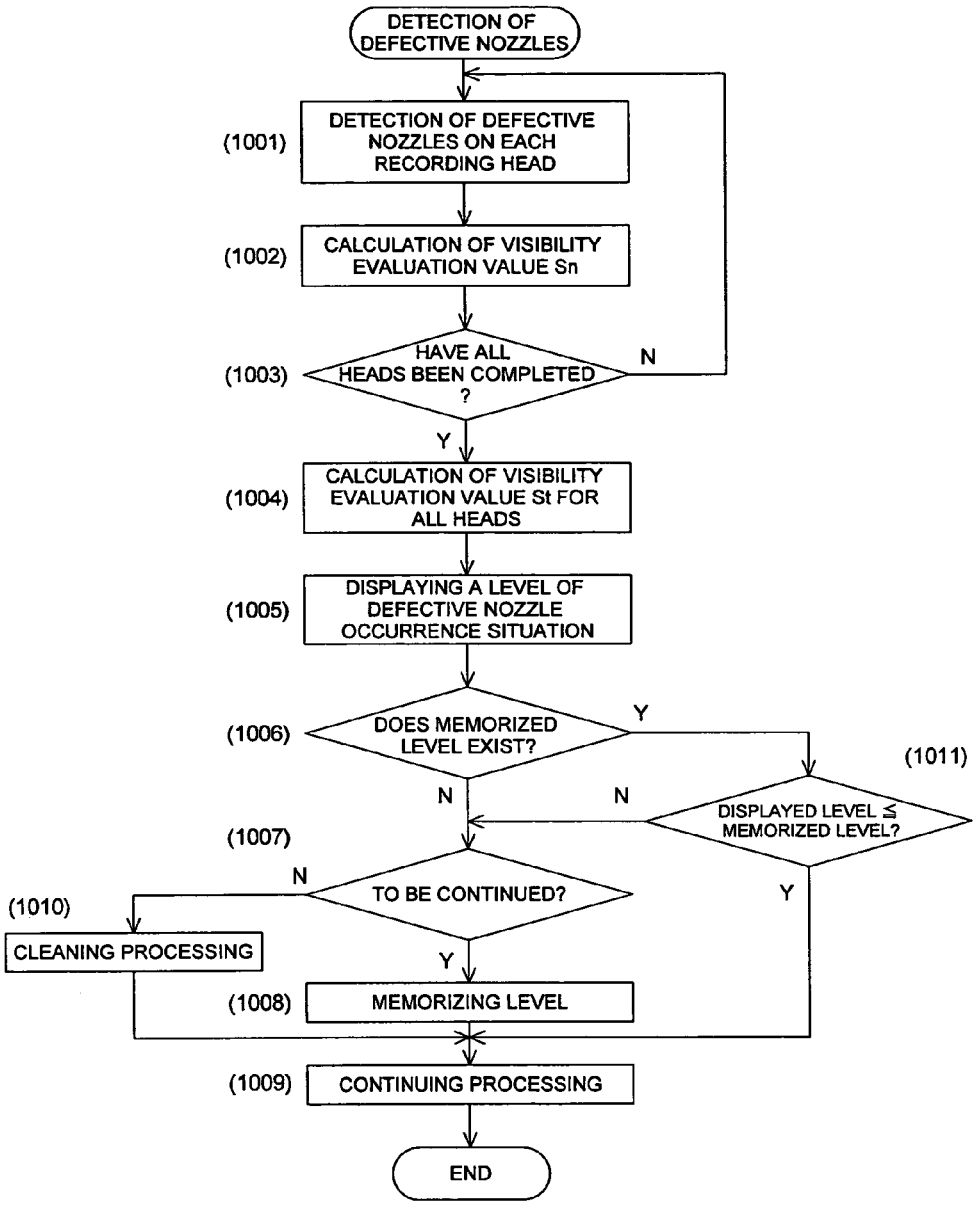
FIG. 5 is a flowchart showing an example of the determination control to carry out the operations of the printer shown in FIG. 3.

Next, an example of the control to execute the operations of the printer in the controller 100 will be described using the flowchart shown in FIG. 5.

At first, the controller 100 causes the light emitting element 8*a* to light to cause the defective nozzle detector 8 to operate, controlling the motor drive section 102 and driving the main scanning motor 5 to move the carriage 2 above the defective nozzle detector 8, subsequently controlling the head drive sections 101 for the recording heads 1*a* through 1*d* and causing each of the nozzles of the recording heads 1*a* through 1*d* to eject ink droplets to carry out the defective nozzle detection (1001).

When the defective nozzle detection relative to one recording head, for example, the recording head 1*a* is carried out by the defective nozzle detector 8, the detection result is input in the controller 100. The controller 100 determines the defective nozzle occurrence situation in the recording head 1*a* based on the detection result, and calculates the visibility evaluation value Sn based on its defective nozzle occurrence situation and the visibility coefficient tables (see FIG. 4) corresponding to the defective nozzle occurrence situation previously memorized (1002).

Figure 6:
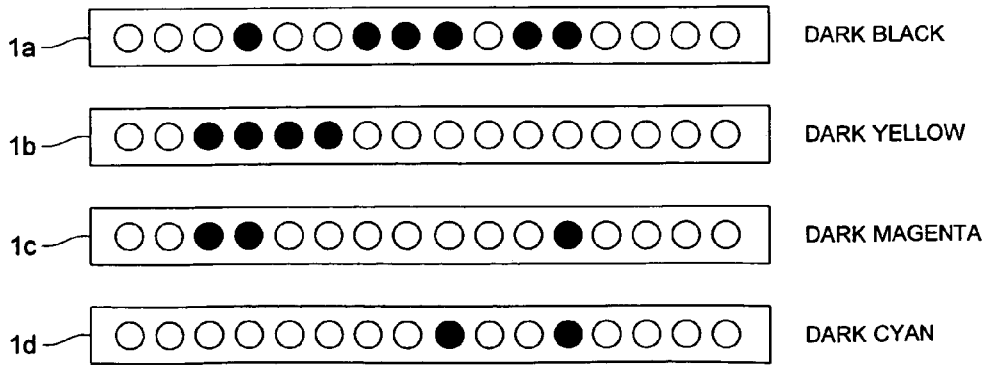
FIG. 6 is a figure to explain an occurrence situation of a defective nozzle.

Herein, the description will be made about calculation examples of the visibility evaluation value Sn and the visibility evaluation value St in the case of defective nozzles occurring as shown in FIG. 6. Incidentally, in FIG. 6, the with circle indicates a normal nozzle and the black circle indicates a defective nozzle, and the ink droplet amount is assumed to be the small droplet.

The visibility evaluation values Sn of the recording heads 1*a* through 1*d* shown in FIG. 6 are calculated based on the above described mathematical equation, wherein one defective nozzle, three consecutive defective nozzles and two consecutive defective nozzles occur in the recording head 1*a* that ejects the dark colored black ink, so that the visibility evaluation value Sn is as follows according to the visibility coefficient table in FIG. 4: the visibility coefficient of the ink color (dark black) "3"×(the consecutive nozzle number "1"×the visibility coefficient "1" of the consecutive nozzle number+the consecutive nozzle number "3"×the visibility coefficient of the consecutive nozzle number "3"+the consecutive nozzle number "2"×the visibility coefficient "2" of the consecutive nozzle number)×the visibility coefficient "1" of the ink droplet amount 42.

Such a calculation of the visibility correction value Sn is carried out for all of the recording heads, and the above steps of 1001 and 1002 are repeated until the calculation is completed for all of the recording heads (1003). Thus, in the case of the recording heads 1*a* through 1*d* shown in FIG. 6, similarly, the visibility coefficient value Sn in the recording head 1*b* which ejects the dark colored yellow ink is to $2\times(4\times4)\times1=32$, in the recording head 1*c* which ejects the dark colored magenta ink to $3\times(2\times2+1\times1)\times1=15$, in the recording head 1*d* which ejects the dark colored cyan ink to $3\times(1\times1+1\times1)\times1=6$.

When having calculated the visibility evaluation values Sn for all of the recording heads 1*a* through 1*d*, the controller 100 then calculates the visibility evaluation value St that is obtained by adding each of the visibility evaluation values Sn of the whole recording heads 1*a* through 1*d* (1004). In the case of the recording heads 1*a* through 1*d* shown in FIG. 6, the visibility evaluation value St, which is calculated based on the above described mathematical equation, is $42+32+15+6=95$.

It is to be understood that the calculation method of the visibility evaluation value Sn is not limited to the above described example, and any other method may be used as long as the result is weighted by the color, indicating that a defect of an image formed by the recording heads is likely to be visually apparent when defective nozzles are consecutive as the substitution value of the evaluation of the defective nozzle occurrence situation for each recording head captured by human eyes.

For example, a value expressed by the following equation may be used as the visibility evaluation value Sn.

$Sn$=[the visibility coefficient of the ink color]×Σ{[the target nozzle is defective (1) or not defective (0)]×Σ[the inverse number of the distance between the target nozzle and the other defective nozzle]} [Mathematical equation]

Next, the controller 100 calculates the visibility evaluation value St that is obtained by adding each of the visibility evaluation values Sn of the whole recording heads 1*a* through 1*d*, causing the display section 300 to display the calculated visibility evaluation value St (1005).

Herein, the controller 100 determines whether the visibility evaluation value St has been already calculated and this visibility evaluation value St is memorized because the printing continuation allowance is selected by the operation of the selection switch 200 from the user (1006), and when it is not memorized, the controller 100 waits an input of the selection switch 200 from the user (1007).

During this time, the user visually confirms the print state to determine influence of the defective nozzle on the image. The user determines whether or not to continue printing and then operates the selection switch 200. As a result, when the printing continuation allowance is selected by the selection switch 200 from the user, the controller 100 memorizes its visibility evaluation St (1008) and begins the print-continue processing (1009).

In the above step 1007, when the printing continuation disallowance is selected by the selection switch 200 from the user, the controller 100 controls the motor drive section 102 and further drives the main scanning motor 5 to move the carriage 2 to the cleaning device 9, carrying out cleaning for all of the recording heads 1*a* through 1*d* by the suctions cap 9*a* and the wiping member 9*b* (1010), and then moving to the print-continue processing (1009).

Further, in the above step 1006, when the visibility evaluation value St has been calculated and this visibility evaluation value St is memorized because the printing continuation allowance is selected by the operation of the selection switch 200 from the user, the controller 100 compares the visibility evaluation value St that is displayed in the display section 300 this time with the visibility evaluation value St memorized therein (1011).

As a result, when the visibility evaluation value St that is displayed in the display section 300 this time is equal or superior to the visibility evaluation value St previously memorized, the controller 100 immediately moves to the print-continue processing without waiting the determination from the user by the selection switch 200 (1009). Further, when the visibility evaluation value St that is displayed in the display section 300 this time is inferior to the visibility evaluation value St previously memorized, the controller 100 moves to the above step 1007, and begins the processing of waiting the determination from the user by the selection switch 200.

With the feature described above, even if a defective nozzle occurs when the user confirms the image at this time and determines the situation is within the level of no problem, it is possible to automatically continue printing without holding up the printer operation each time, so that printing will not be frequently interrupted each time the defective nozzle is detected, thereby the problem of occurring the time loss will be eliminated.

Incidentally, it is also preferable that the controller 100 moves again to the above step 1001 after having carried out the cleaning processing in the above step 1010 and detects again defective nozzles to confirm the defective nozzle recovery state. In this time, when the level of the defective nozzle occurrence situation is the same level due to re-cleaning, the warning display and the like may be made in the display section 300 as the printing continuation is impossible to urge the user to replace the head and the like.

Figure 7:
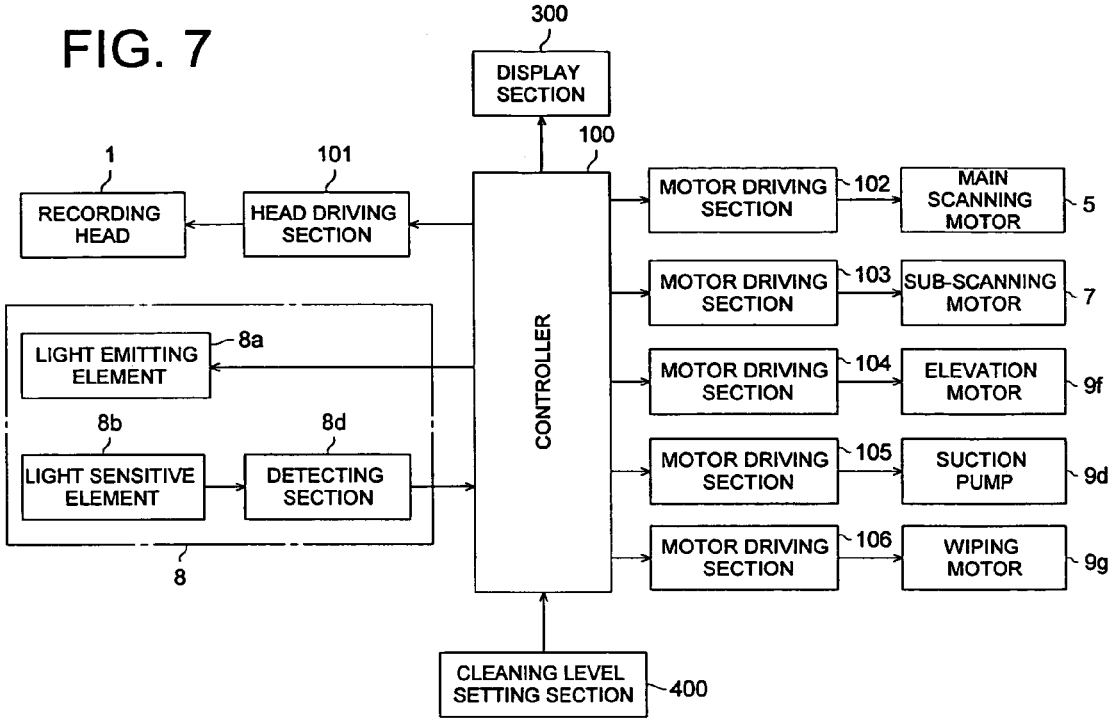
FIG. 7 is a block diagram showing the inside configuration of the key sections of another inkjet printer.

FIG. 7 is a block diagram showing the inside configuration of the key parts of an inkjet printer according to another aspect. The same reference numerals as in FIG. 3 indicate the same components, and the detailed description will be omitted.

This inkjet printer is provided with a cleaning level setting section 400 in place of the selection switch 200 shown in FIG. 3. The cleaning level setting section 400 receives a cleaning level setting by a user's operation, and inputs the setting result in the controller 100.

Herein, the cleaning level is meant as a reference of whether or not to carry out cleaning for the recording head 1 depending on the defective nozzle occurrence situation detected by the defective nozzle detector 8. The cleaning level can be set by stages, for example, to five levels depending on the degree of the necessity of carrying out the cleaning operation, which is selectively set and input by the user with an appropriate input means such as an input from a numeric keypad, an input from a dedicated button, or a touch input on a touch panel.

The cleaning level also can be fixed at any level and previously memorized within a nonvolatile memory of the controller 100, which is the case where the cleaning level setting section 400 is not necessary, however, when the cleaning level setting section 400 is provided as shown in the present embodiment, the cleaning level can be arbitrarily set and modified by different user depending on the circumstances such as image data, a recording medium to be used, and a print production state, so that a highly versatile printer can be realized.

Next, the determination control to carry out the operations of the printer in the inkjet printer shown in FIG. 7 will be described using the flowchart shown in FIG. 8.

At first, the controller 100 causes the light emitting element 8*a* to light to cause the defective nozzle detector 8 to operate, controlling the motor drive section 102 and driving the main scanning motor 5 to move the carriage 2 above the defective nozzle detector 8, subsequently controlling the head drive sections 101 of the recording heads 1*a* through 1*d* and causing the nozzles of the recording heads 1*a* through 1*d* to respectively eject ink droplets to detect defective nozzles (2001).

When the defective nozzle detection for one recording head, for example for the recording head 1*a* is carried out by the defective nozzle detector 8, the detection result is input in the controller 100. The controller 100 determines the defective nozzle occurrence situation in the recording head 1*a* based on the detection result, and calculates the visibility evaluation value Sn based on the defective nozzle occurrence situation thereof and the visibility coefficient tables corresponding to the defective nozzle occurrence situation previously memorized (2002).

Herein, when defective nozzles occur as shown in FIG. 6, the visibility evaluation values Sn are calculated similarly to the above description, wherein the visibility evaluation value Sn for the dark black is "42", the visibility evaluation value Sn for the dark yellow is "32", the visibility evaluation value for the dark magenta is "15", and the visibility evaluation value Sn for the dark cyan is "6".

When having calculated the visibility evaluation values Sn for all of the recording heads 1*a* though 1*d*, the controller 100 then calculates the visibility evaluation value St that is obtained by adding each of the visibility evaluation values Sn for the whole recording heads 1*a* through 1*d* (2004). This visibility evaluation value St is calculated similarly to the above, and in the case of the recording heads 1*a* through 1*d* shown in FIG. 6, the result is 42+32+15+6=95.

Next, the controller 100 first compares the visibility evaluation value St that is obtained by adding each of the visibility evaluation values Sn for the whole recording heads 1*a* through 1*d* with a comparison reference to determine the next printer operation (2005).

This comparison reference is a reference of whether or not to carry out the cleaning operation to recover defective nozzles, as mentioned above, the reference may be previously set within the nonvolatile memory of the controller 100 or may be selected and set from the user by the cleaning level setting section 400. The latter aspect will be described herein.

An example of the cleaning level which is set by the user is shown in FIG. 9. The cleaning level is divided into five levels in order from the highest level to the lowest level of the necessity of the cleaning operation, and for each of the levels, the reference value of the visibility evaluation value Sn for each recording head and the reference value of the visibility evaluation value St for whole recording heads are set.

Herein, in the case of the recording heads 1*a* through 1*d* shown in FIG. 6, the visibility evaluation value St is "95", and this value is compared with the reference value set for the cleaning level. Herein, when the cleaning level is set to level 4 by the user, the reference value of the visibility evaluation value St is "150" and the cleaning operation is not carried out as the next printer operation, while when the cleaning level is set to level 3, the reference value of the visibility evaluation value St is "40", thereby the controller 100 controls the motor drive section 102 and further drives the main scanning motor 5 to move the carriage 2 to the cleaning device 9, and then carrying out cleaning as the next printer operation for all of the recording heads 1*a* through 1*d* by the suction caps 9*a* and the wiping member 9*b* (2006). In this time, the defective nozzle occurrence situation and the visibility evaluation value St thereof may be displayed on display section 300.

As a result of the comparison in the above step 2005, when the cleaning operation is not carried out as the next printer operation, the controller 100 then compares each of the visibility valuation values Sn for the recording heads 1*a* through 1*d* with the comparison reference to determine the next printer operation (2007).

In the case of the recording heads 1*a* through 1*d* shown in FIG. 6, the respective visibility evaluation values Sn for the recording head 1*a* is "42", for the recording head 1*b* is "32", for the recording head 1*c* is "15", and for the recording head 1*d* is "6", and if the cleaning level is set to level 4 by the user, the visibility evaluation values Sn for the recording heads 1*a* and 1*b* both exceed the reference value "30" which is set for level 4, and thereby the controller 100 controls the motor drive section 102 and further drives the main scanning motor 5 to move the carriage 2 to the cleaning device 9, and then carrying out cleaning as the next printer operation by the suction caps 9*a* and the wiping member 9*b* for the recording heads 1*a* and 1*b* whose visibility evaluation values Sn both exceed the reference value (2008). In this time, the defective nozzle occurrence situation and the visibility evaluation values Sn thereof may be displayed on the display section 300.

From the result of the comparison in the step of 1007, in the case where the cleaning operation is not carried out for all of the recording heads 1*a* through 1*d* or when the cleaning operation in the step of 2006 and step 2008 are completed, the controller 100 restarts the printing operation and goes to print-continue processing (2009). Thus, in the case where the recording medium is a cloth such as a towel in which the printing state is less required, the cleaning level shown in FIG. 9 is set to level 5 so that the cleaning operation is not carried out at all in the defective nozzle occurrence situation of the recording heads 1*a* through 1*d* shown in FIG. 6, and the time loss due to the cleaning operation will not occur.

With the feature described above, the printer operation can adequately controlled depending on the defective nozzle occurrence situation detected by the defective nozzle detector 8, so that the time loss due to the execution of unnecessary cleaning operation will not occur, and thereby the productivity can be improved.

Further, when the cleaning level has been set as levels for each of the recording heads, namely, like the reference values for the visibility evaluation value Sn shown in FIG. 9, the necessity of the cleaning operation can be determined for each of the recording heads 1*a* through 1*d* depending on the defective nozzle occurrence situation, so that the unnecessary operation will not be carried out for a defective nozzle in a recording head of a color which is not likely to be visually apparent and the like.

Further, when the cleaning level has been set as levels for the whole recording heads of the plurality of recording heads 1*a* through 1*d* all together, namely, like the reference values for the visibility evaluation value St shown in FIG. 9, the defective nozzle occurrence situation can be determined as a whole in the plurality of recording heads, so that it will be possible to determine more precisely whether the defective nozzles are likely to be visually apparent in the image which is printed by the plurality of recording heads.

Naturally, having the above two levels as shown in FIG. 7, the operations of the printer is controlled more adequately.

Further, though the description was made about the case of using the visibility evaluation values for calculating the level of the defective nozzle occurrence situation, naturally, the present invention also includes an inkjet printer with a configuration using a method other than the method as described above that, when a defective nozzle is detected, users confirm the printed image and sets the level at this point as allowable, an inkjet printer having a constitution controlling determination whether or not to carry out the printing stop operation based on this level afterward.

Figure 8:
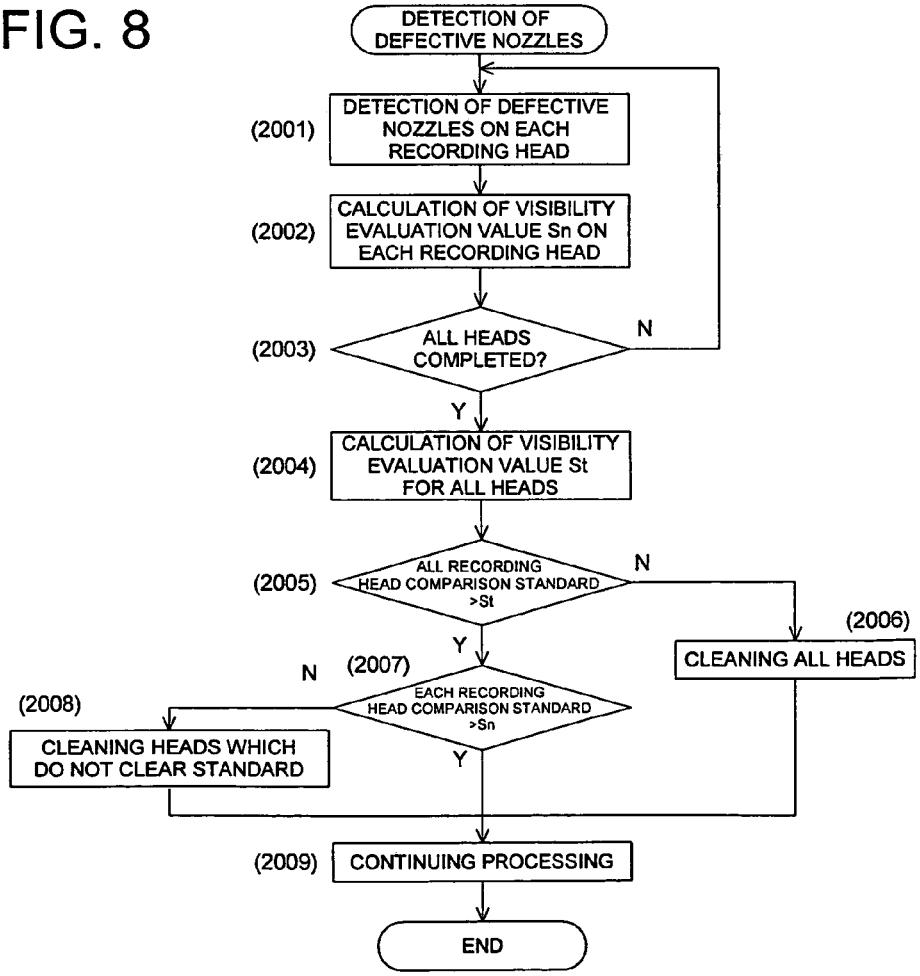
FIG. 8 is a flowchart showing an example of the determination control to carry out the operations of the printer shown in FIG. 7.

Incidentally, in the flowchart of FIG. 8, when either of the steps of 2006 or 2008 is carried out, it is preferred to control in order that returning to step 2001 again, the recovery state of defective nozzles may be confirmed by carrying out again the defective nozzle detection operation. At this time, when a defective nozzle occurs again at the same place, it is preferable to control to carry out the printing stop operation as the next printer operation. In this case, a warning display such as for urging the user to replace the head may be made in the display section 300.

Incidentally, in the inkjet printer shown in FIG. 7 and FIG. 8, the setting section is designed to set the level at which cleaning is carried out as the cleaning level setting section 400, but not limited to this, it may be configured to set the level of controlling the execution of other printer operations. For example, the setting section may also be configured to simply set the level at which the printing continuation is allowed or disallowed.

In the above description, the inkjet printer of the type in which the recording head is mounted in the carriage and moves forward and backward along the main scanning direction is exemplified, but not limited to this, and the recording head may be a line-type recording head that carries out recording at a time across the width of the recording medium.

What is claimed is:

1. An ink jet printer, comprising:

a recording head having a plurality of nozzles;

a defective nozzle detecting device to check each of the nozzles of the recording head so as to detect defective nozzles from which ink droplets are not ejected;

a determination device for determining an evaluation value of a defective nozzle occurrence situation based on a detection result of the defective nozzles;

an operation control device for controlling operation of the printer head based on a determination result in the determination device;

a reception device for receiving an input from a user that allows or disallows continuation of a printing operation;

wherein the evaluation value is set through the reception device, when the input that allows the continuation of the printing operation is received through the reception device, the operation control device memorizes the evaluation value at time of the receipt of the input and printing operation is continued, then if the evaluation value of subsequent print is superior to the memorized evaluation value, the printing operation is continued without waiting for the input from the user that allows or disallows the continuation of a printing operation, and if the evaluation value of subsequent print is inferior to the memorized evaluation value, the printing operation is discontinued until the input that allows or disallows the continuation of the printing operation is received, and then if the input that allows the continuation of the printing operation is received through the reception device, the operation control device replaces the memorized evaluation value with a new evaluation value at the time of the input is received.

2. An ink jet printer in claim 1, wherein the operation control device controls whether to continue the printing operation of the printer or to execute the cleaning operation to recover a defective nozzle of the recording head as the printer operation.

3. An ink jet printer in claim 1, wherein defective nozzle occurrence situation level is the level that is converted into numerical values indicating whether the defective nozzle is likely or unlikely to be visually apparent in an image based on the detection result of the defective nozzle detection device.

4. An ink jet printer in claim 1, wherein the defective nozzles occurrence situation Includes information about a consecutive nozzles number of adjacent defective nozzles.

5. An ink jet printer in claim 1, wherein the defective nozzles occurrence situation includes information about the colors of the ink droplets ejected from the nozzles of the recording head.

6. An ink jet printer in claim 1, wherein the recording head is a plurality of recording heads, and a defective nozzle occurrence situation level is the level for each of the recording heads.

7. An ink jet printer in claim 1, wherein the recording head is a plurality of recording heads, and a defective nozzle occurrence level is a level for all of recording heads together.

* * * * *